US010986931B2

(12) United States Patent
Lu

(10) Patent No.: US 10,986,931 B2
(45) Date of Patent: Apr. 27, 2021

(54) ELECTRIC ADJUSTMENT DEVICE FOR SOFA HEADREST AND SOFA SUPPORT DEVICE

(71) Applicant: Dongguan Weihong Smart Home Technology Co., Ltd., Dongguan (CN)

(72) Inventor: Wei Lu, Dongguan (CN)

(73) Assignee: DONGGUAN WEIHONG SMART HOME TECHNOLOGY CO., LTD., Dongguan (CN)

( * ) Notice: Subject to any disclaimer, the term of this patent is extended or adjusted under 35 U.S.C. 154(b) by 68 days.

(21) Appl. No.: 16/671,648

(22) Filed: Nov. 1, 2019

(65) Prior Publication Data

US 2021/0059423 A1 Mar. 4, 2021

(30) Foreign Application Priority Data

Aug. 30, 2019 (CN) ..... 201910822244.0

(51) Int. Cl.

| | |
|---|---|
| ***A47C 20/04*** | (2006.01) |
| ***A47C 17/04*** | (2006.01) |
| ***A47C 7/38*** | (2006.01) |
| ***A47C 1/036*** | (2006.01) |

(52) U.S. Cl.

CPC ..... *A47C 20/041* (2013.01); *A47C 1/036* (2013.01); *A47C 7/38* (2013.01); *A47C 17/04* (2013.01)

(58) Field of Classification Search

CPC ..... A47C 20/041; A47C 1/036; A47C 7/38; A47C 1/022

See application file for complete search history.

(56) References Cited

U.S. PATENT DOCUMENTS

| | | | | |
|---|---|---|---|---|
| 8,702,173 | B2 * | 4/2014 | Adams | A47C 7/38 297/408 |
| 9,399,421 | B2 * | 7/2016 | Lu | A47C 7/38 |
| 9,723,931 | B2 * | 8/2017 | Lu | A47C 17/04 |
| 9,861,204 | B2 * | 1/2018 | Lu | A47C 7/38 |

* cited by examiner

*Primary Examiner* — David R Dunn
*Assistant Examiner* — Tania Abraham
(74) *Attorney, Agent, or Firm* — Shimokaji IP

(57) ABSTRACT

An electric adjustment device for sofa headrest includes a first fixing member, a second fixing member, and a drive device having an output end that linearly reciprocates. One end of the second fixing member is pivotally connected to the first fixing member, and the drive device is pivotally connected to the first fixing member and arranged flush with the first fixing member. A sliding direction of the output end is perpendicular to a pivotal axis about which the second fixing member is pivotable to the first fixing member. Specifically, the second fixing member is extended downward to form a fixed end for fixing to a backrest support frame. The electric adjustment device is installed in the headrest support frame instead of the backrest support frame, so that other functional parts are installed inside internal space of the backrest support frame which improves the function of the sofa.

10 Claims, 6 Drawing Sheets

ELECTRIC ADJUSTMENT DEVICE FOR SOFA HEADREST AND SOFA SUPPORT DEVICE

RELATED APPLICATIONS

This application claims the benefit of priority to Chinese Patent Application No. 201910822244.0 filed on Aug. 30, 2019, which is hereby incorporated by reference in its entirety.

FIELD OF THE INVENTION

The present invention relates to a furniture part, more particularly to an electric adjustment device for sofa headrest and sofa support device.

BACKGROUND OF THE INVENTION

Usually, in order to make a user feel more comfortable, the sofa headrest is designed to be angle-adjustable. For example, a hinge is arranged between a sofa body and a headrest, and the headrest is manually adjusted. Or, preferably, an adjustment device having an automatic device drivers is installed in the backrest support frame of the sofa. Furthermore, a movable part of the adjustment device is fixedly connected to the headrest support frame, and the adjustment device moves to automatically adjust the angle of the headrest.

Chinese Patent No. 104172793 discloses a multifunctional lifting device which has a large volume and high height, and a movable part of the lifting device swings up and down relative to the device body. Furthermore, the movable part is inserted upward into the headrest support frame for fixing, so the existing adjustment device is only installed in the backrest support frame in general. Therefore, the inner space inside the backrest support frame is occupied, and it is difficult to install other functional devices such as massage devices and physiotherapy devices, which limits the sofa function.

Thus, it's necessary to provide an electric adjustment device for sofa headrest which has compact structure and does not need to be installed inside the backrest support frame of the sofa.

SUMMARY OF THE INVENTION

One objective of the present invention is to provide an electric adjustment device for sofa headrest which has compact structure and does not need to be installed inside a backrest support frame of a sofa.

To achieve the above objective, an electric adjustment device for sofa headrest includes a first fixing member, a second fixing member, and a drive device having an output end that linearly reciprocates. One end of the second fixing member is pivotally connected to the first fixing member, and the drive device is pivotally connected to the first fixing member and arranged flush with the first fixing member. A sliding direction of the output end is perpendicular to a pivotal axis about which the second fixing member is pivotable to the first fixing member. Furthermore, the output end is hinged with a connecting member. Specifically, the connecting member is fixed at one end of the second fixing member to which the first fixing member is pivotally connected, and the other end of the second fixing member is extended downward relatively to the first fixing member and the drive device to form a fixed end for fixing to a backrest support frame.

In comparison with the prior art, since the drive device of the electric adjustment device in this application is arranged flush with the first fixing member. Furthermore, one end of the second fixing member is pivotally connected to the first fixing member, and the other end of the second fixing member is extended downward relatively to the first fixing member and the drive device to form a fixed end for fixing to a backrest support frame. Moreover, the connecting member hinged with the output end of the drive device is fixed at one end of the second fixing member to which the first fixing member is pivotally connected. A sliding direction of the output end is perpendicular to a pivotal axis about which the second fixing member is pivotable to the first fixing member. Therefore, when the second fixing member is not moved, the output end stretches out and draws back relatively to the drive device which will drive the first fixing member and the drive device to swing relatively to the second fixing member, thereby adjusting the angle of the sofa headrest. Since the drive device is arranged in a particular way, and the output end is connected to the two fixing members in a particular manner, which avoids the problem of large volume and high height in the existing adjustment device. Furthermore, the electric adjustment device will be installed in the headrest support frame, instead of being installed in the backrest support frame, so that other functional parts are installed inside internal space of the backrest support frame, which improves the function of the sofa.

Preferably, the drive device is an electric push rod, and the output end is a push rod of the electric push rod.

Preferably, the first fixing member includes a straight first pivoting arm and a headrest mounting arm which is fixed to one end of the first pivoting arm and formed an L-shaped structure with the first pivoting arm. Furthermore, the drive device is pivotally connected to the headrest mounting arm, and one end of the second fixing member is pivotally connected to the first pivoting arm.

Preferably, the second fixing member is arranged between the drive device and the first pivoting arm.

Preferably, the first fixing member further includes a limit arm fixed to one end of the headrest mounting arm and bent relatively to the headrest mounting arm, and the drive device is located in a range enclosed by the first pivoting arm, the headrest mounting arm, and the limit arm.

Preferably, the second fixing member has an L-shaped structure and includes a second pivoting arm pivotally connected to the first fixing member and a backrest fixing arm extending downwardly relatively to the second pivoting arm, and the fixed end is located on the backrest fixing arm.

Preferably, a connecting portion in a flat structure is formed at one end of the second pivoting arm and pivotally connected to the connecting portion, and the connecting member is also fixed to the connecting portion.

Preferably, two limit surfaces are arranged at one end of the first fixing member pivotally connected to the second fixing member, the second fixing member is provided with a positioning stud between the two limit surfaces, and the positioning stud cooperates with the two limit surfaces to limit a swing range of the first fixing member and the second fixing member.

Another objective of the present invention is to provide a sofa support device with the above-mentioned electric adjustment device for sofa headrest.

A sofa support device includes a headrest support frame, a backrest support frame, and the above-mentioned electric adjustment device. Specifically, the first fixing member is fixed to the headrest support frame, and the fixed end of the second fixing member is fixed on the backrest support frame.

In comparison with the prior art, since the electric adjustment device in the sofa support device is disposed in the headrest support frame, the inner space inside the backrest support frame is not occupied, and can be used for setting other functional parts, which improves the function of the sofa.

Preferably, the sofa support device further includes an auxiliary hinge. The electric adjustment device is disposed at one end of the headrest support frame and the backrest support frame, and the auxiliary hinge is disposed at the other end of the headrest support frame and the backrest support frame. Moreover, the auxiliary hinge includes a first hinge fixed to the headrest support frame and a second hinge pivotally connected to the first hinge and fixed to the backrest support frame.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
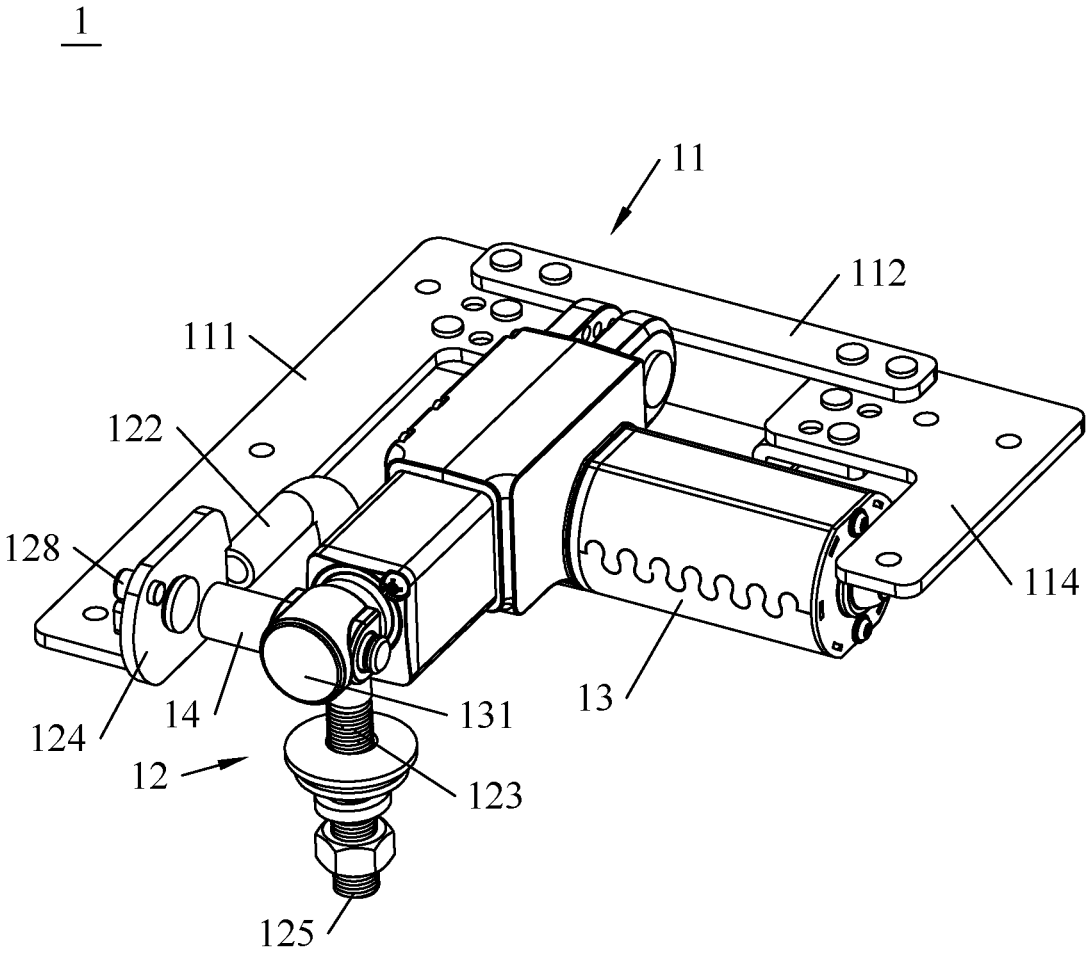
FIG. 1 is a perspective view of an electric adjustment device for sofa headrest according to an embodiment of the present invention.
Figure 2:
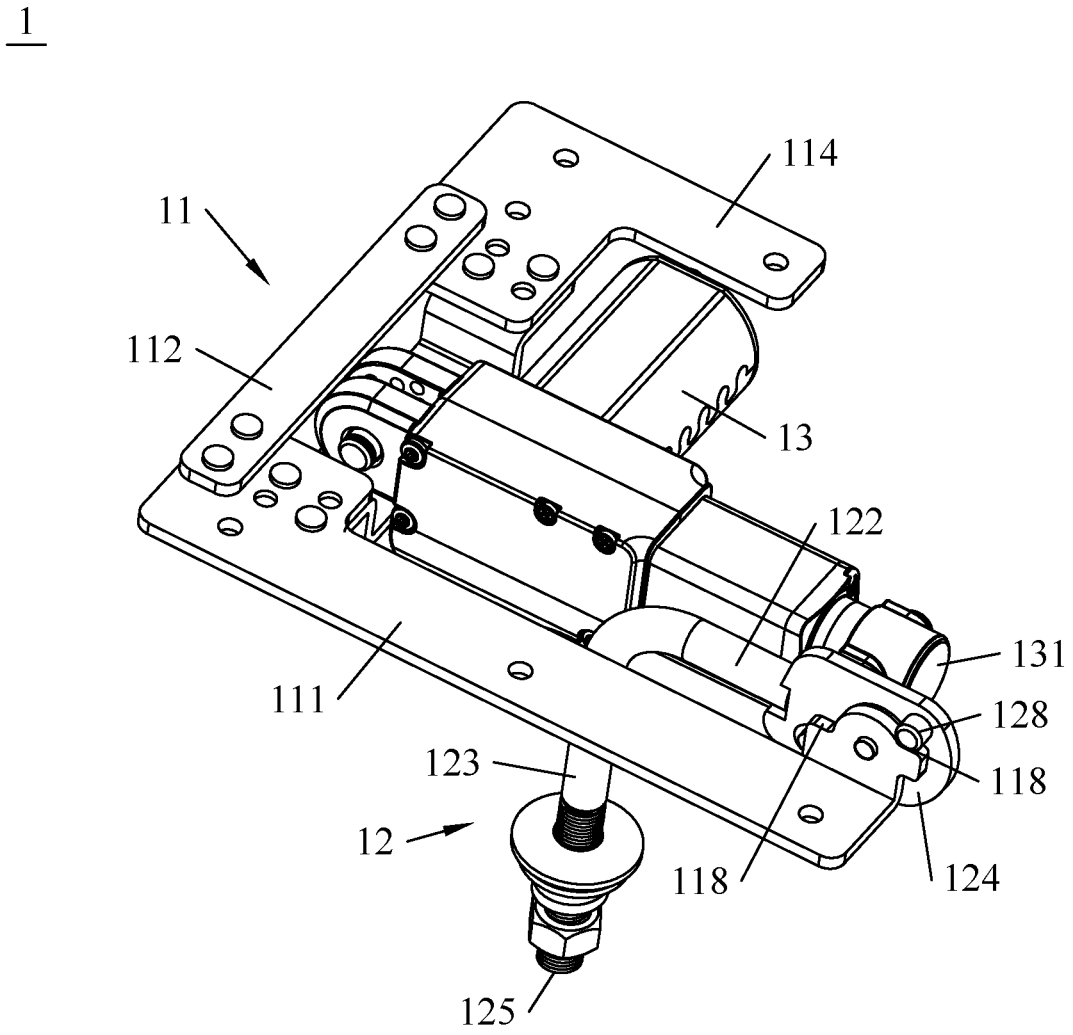
FIG. 2 is a perspective view of the electric adjustment device viewed from another angle.
Figure 3:
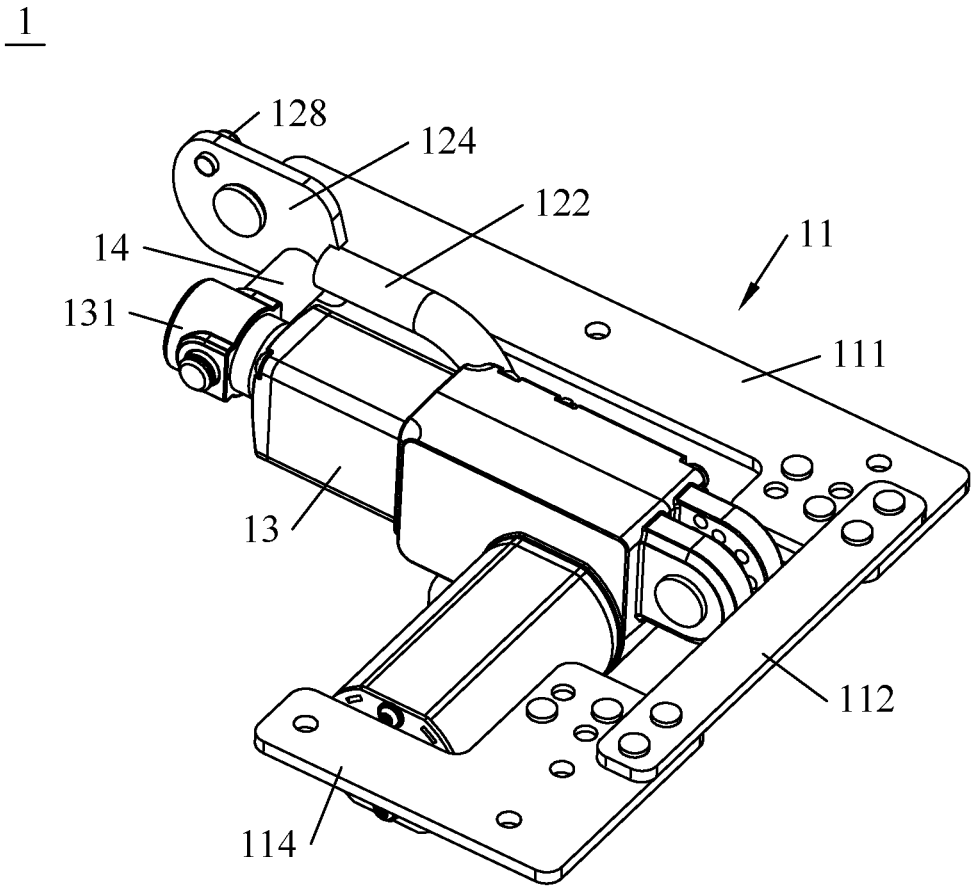
FIG. 3 is a perspective view of the electric adjustment device viewed from another angle.

For further understanding the features, technical solutions, purposes and functions of the present invention, and explaining the advantages and spirits of the invention, detailed descriptions for embodiments follow.

As shown in FIGS. 1-4, an electric adjustment device 1 for sofa headrest includes a first fixing member 11, a second fixing member 12, and a drive device 13 having an output end 131 that linearly reciprocates. Specifically, the first fixing member 11 is fixed to a headrest support frame of the sofa, and the second fixing member is arranged for fixing to a backrest support frame of the sofa.

Specifically, one end of the second fixing member 12 is pivotally connected to the first fixing member 11, and the drive device 13 is pivotally connected to the first fixing member 11 and arranged flush with the first fixing member 11. A sliding direction of the output end 131 is generally perpendicular to a pivotal axis about which the second fixing member 12 is pivotable to the first fixing member 11. Furthermore, the output end 131 is hinged with a connecting member 14. Specifically, the connecting member 14 is fixed at one end of the second fixing member 12 to which the first fixing member 11 is pivotally connected, and the fixed position of the connecting member 14 is close to a pivotable position where the second fixing member 12 is pivotally connected to the first fixing member 11. The other end of the second fixing member 12 is extended downward relatively to the first fixing member 11 and the drive device 13 to form a fixed end for fixing to the backrest support frame.

More specifically, the first fixing member 11 includes a straight first pivoting arm 111 and a headrest mounting arm 112 which is fixed to one end of the first pivoting arm 111 and formed an L-shaped structure with the first pivoting arm 111. The output end 131 is located at one end of the drive device 13, and the other end of the drive device 13 is pivotally connected to the headrest mounting arm 112. One end of the second fixing member 12 is pivotally connected to the first pivoting arm 111. Preferably, the first fixing member 11 further includes a limit arm 114 fixed to one end of the headrest mounting arm 112 and bent relatively to the headrest mounting arm 112, and the drive device 13 is located in a range enclosed by the first pivoting arm 111, the headrest mounting arm 112, and the limit arm 114. Preferably, the length and width of the first fixing member 11 is significantly larger than the height thereof, and the length and width of the drive device 13 are also significantly larger than the height thereof. Moreover, the drive device 13 is arranged flush with the first fixing member 11 that means the length and width of the drive device 13 and the first fixing member 11 are substantially the same. The drive device 13 and the first fixing member 11 together form an adjustment device structure whose length and width are significantly larger than the thickness.

Since the output end 131 is connected to the second fixing member 12 by the connecting member 14, a gap is defined between the drive device 13 and the first pivoting arm 111, and the second fixing member 12 is located between the drive device 13 and the first pivoting arm 111. Preferably, the second fixing member 12 has an L-shaped structure and includes a second pivoting arm 122 and a backrest fixing arm 123. Specifically, the second pivoting arm 122 is pivotally connected to the first pivoting arm 111 and flush with the first pivoting arm 111 and the drive device 13. The backrest fixing arm 123 extends downwardly relatively to the second pivoting arm 122, and the fixed end 125 is located on the backrest fixing arm 123. A nut, a gasket, or the like may be provided on the backrest fixing arm 123 for auxiliary mounting. Preferably, a connecting portion 124 in a flat structure is formed at one end of the second pivoting arm 122 and pivotally connected to the first pivoting arm 111, and the connecting member 14 is also fixed to the connecting portion 124.

Preferably, two spaced limit surfaces 118 are arranged at the pivotable position where the first pivoting arm 111 is pivotally connected to the second pivoting arm 122, and the connecting portion 124 of the second pivoting arm 122 is provided with a positioning stud 128 between the two limit surfaces 118. When the first fixing member 11 swings relatively to the second fixing member 12, the positioning stud 128 moves between the two limit surfaces 118, therefore the positioning stud 128 cooperates with the two limit surfaces 118 to limit a swing range of the first fixing member 11 and the second fixing member 12.

Specifically, in this embodiment, the drive device 13 is an electric push rod, and the output end 131 is a push rod of the electric push rod. In other embodiments, the drive device 13 may also be other devices, such as the drive device having a motor and a lead screw nut as an output end 131.

Figure 4:
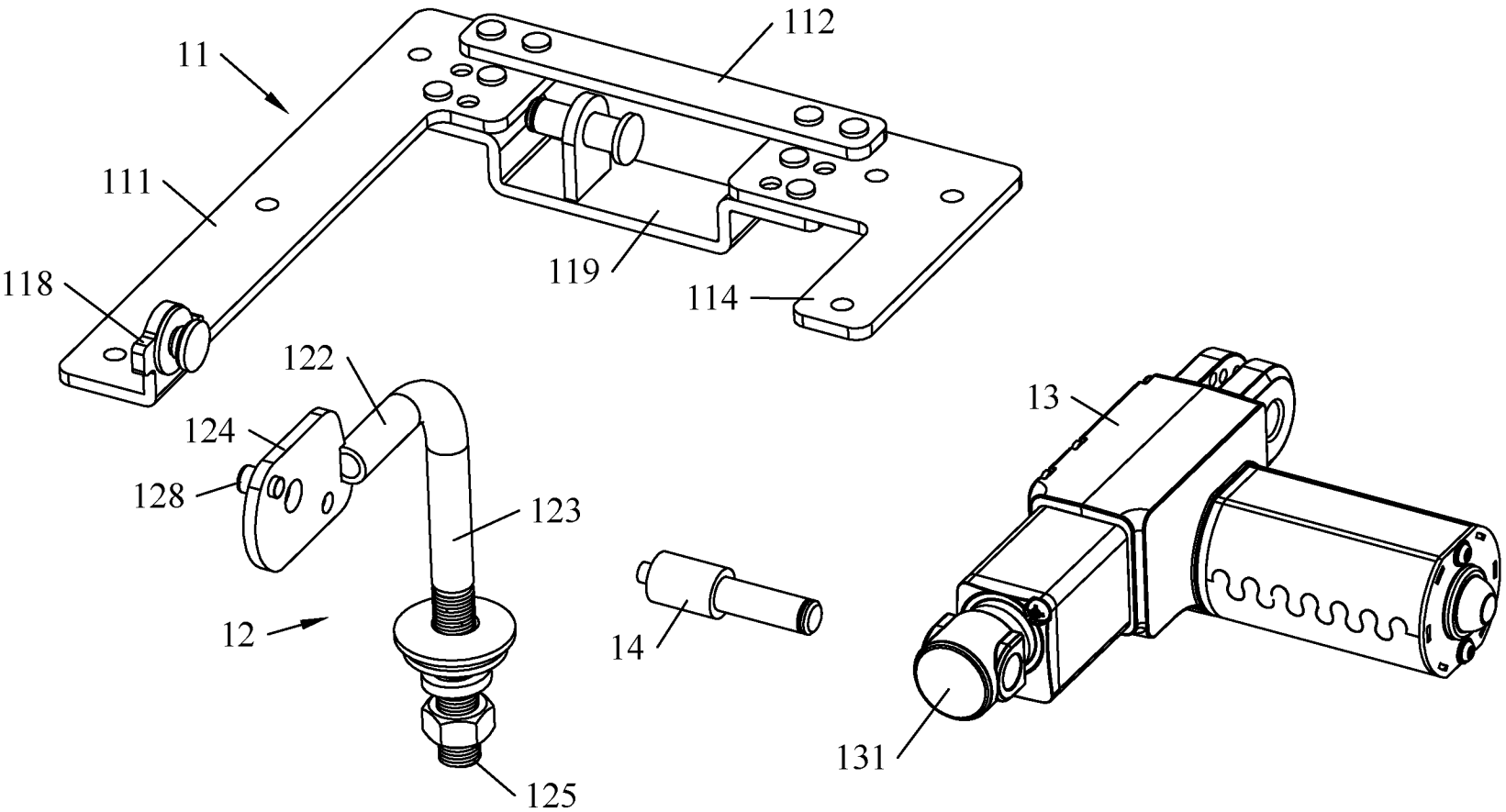
FIG. 4 is an exploded view of the electric adjustment device.

Referring to FIG. 4, the headrest mounting arm 112 has a mounting position 119 recessed relatively to the first pivoting arm 111 and the limit arm 114. One end of the drive device 13 is pivotally mounted on the mounting position 119. By providing the recessed mounting position 119, it is ensured that the drive device 13 is flush with the first fixing member 11 after the drive device 13 being mounted.

Figure 5:
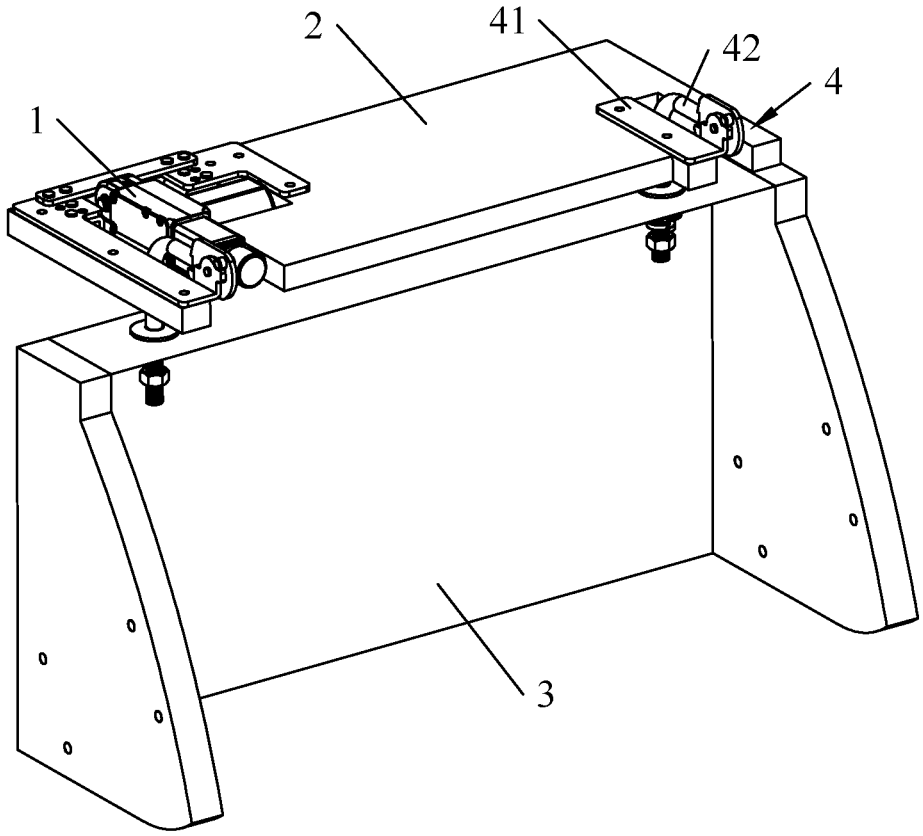
FIG. 5 is a schematic diagram of a sofa support device according to an embodiment of the present invention.
Figure 6:
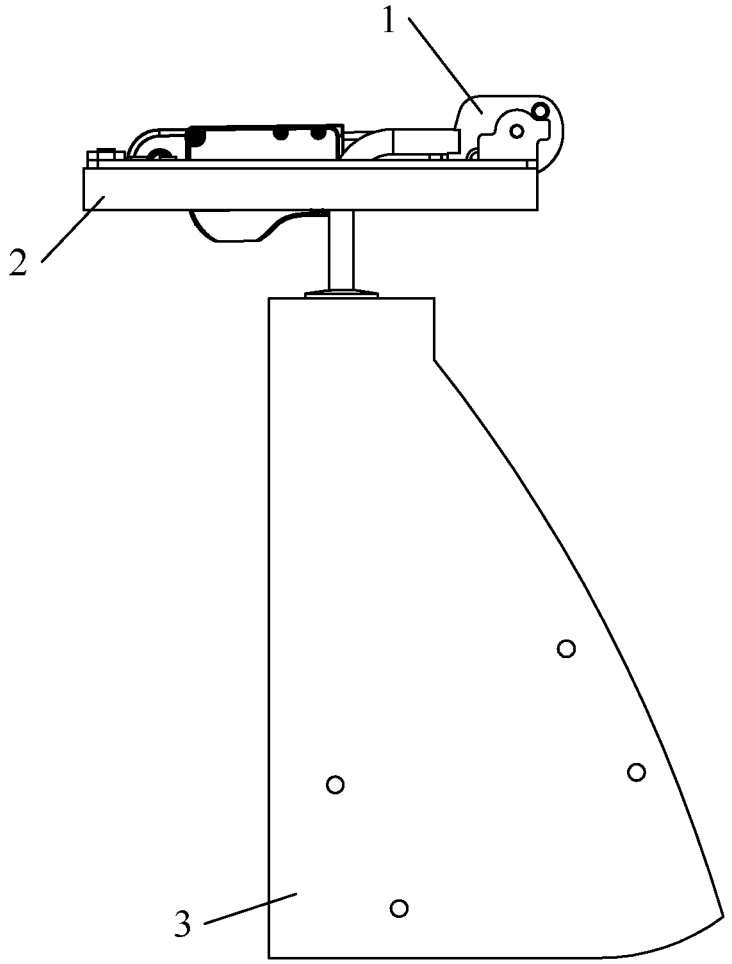
FIG. 6 is a side elevational view of the sofa support device in FIG. 5.

Referring to FIGS. 5 and 6, a sofa support device is provided, which includes a headrest support frame 2, a backrest support frame 3, and the above-mentioned electric adjustment device 1. Specifically, the headrest support frame 2 is fixed and supported in the headrest of the sofa. The backrest support frame 3 is fixed and supported in the backrest of the sofa. The first fixing member 11 is fixed to the headrest support frame 2, and the fixed end 125 of the second fixing member 12 is fixed to the backrest support frame 3. Preferably, the electric adjustment device 1 is disposed at one end of the headrest support frame 2 and the backrest support frame 3, and the auxiliary hinge 4 is disposed at the other end of the headrest support frame 2 and the backrest support frame 3. Moreover, the auxiliary hinge 4 includes a first hinge 41 fixed to the headrest support frame 2 and a second hinge 42 pivotally connected to the first hinge 41 and fixed to the backrest support frame 3. The above-mentioned limit surface 118 and the positioning stud 128 are also provided between the first hinge 41 and the second hinge 42. By providing the electric adjustment device 1 and the auxiliary hinge 4 at the both ends of the headrest support frame 2 and the backrest support frame 3, the headrest support frame 2 can be more stably supported, which is advantageous for maintaining the stability during the headrest support frame 2 swinging.

In comparison with the prior art, the drive device 13 of the electric adjustment device 1 is arranged flush with the first fixing member 11. Furthermore, one end of the second pivoting arm 122 is pivotally connected to the first pivoting arm 111, and the other end of the second pivoting arm 122 is extended downward relatively to the first fixing member 11 and the drive device 13 to form the fixed end for fixing to the backrest support frame 3. Moreover, the connecting member 14 hinged with the output end 131 of the drive device 13 is fixed at one end of the second fixing member 12 to which the first fixing member 11 is pivotally connected. A sliding direction of the output end 131 is perpendicular to a pivotal axis about which the second pivoting arm 122 is pivotable to the first pivoting arm 111. Therefore, when the second fixing member 12 is not moved, the output end 131 stretches out and draws back relatively to the drive device 13 which will drive the first fixing member 11 and the drive device 13 to swing relatively to the second fixing member 12, thereby adjusting the angle of the sofa headrest. Since the drive device 13 is arranged in a particular way, and the output end 131 is connected to the two fixing members in a particular manner, which avoids the problem of large height scale in the existing adjustment device. Thus, the electric adjustment device 1 will be installed in the headrest support frame 2, instead of being installed in the backrest support frame 3, so that other functional parts is installed inside internal space of the backrest support frame 3, which improves the function of the sofa.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An electric adjustment device for sofa headrest, comprising a first fixing member, a second fixing member, and a drive device having an output end that linearly reciprocates, wherein one end of the second fixing member is pivotally connected to the first fixing member, the drive device is pivotally connected to the first fixing member and arranged flush with the first fixing member, a sliding direction of the output end is perpendicular to a pivotal axis about which the second fixing member is pivotable to the first fixing member, the output end is hinged with a connecting member, the connecting member is fixed at one end of the second fixing member to which the first fixing member is pivotally connected, and the other end of the second fixing member is extended downward relatively to the first fixing member and the drive device to form a fixed end for fixing to a backrest support frame.

2. The electric adjustment device for sofa headrest according to claim 1, wherein the drive device is an electric push rod, and the output end is a push rod of the electric push rod.

3. The electric adjustment device for sofa headrest according to claim 1, wherein the first fixing member comprises a straight first pivoting arm and a headrest mounting arm which is fixed to one end of the first pivoting arm and forms an L-shaped structure with the first pivoting arm, the drive device is pivotally connected to the headrest mounting arm, and one end of the second fixing member is pivotally connected to the first pivoting arm.

4. The electric adjustment device for sofa headrest according to claim 3, wherein the second fixing member is arranged between the drive device and the first pivoting arm.

5. The electric adjustment device for sofa headrest according to claim 3, wherein the first fixing member further comprises a limit arm fixed to one end of the headrest mounting arm and bent relatively to the headrest mounting arm, and the drive device is located in a range enclosed by the first pivoting arm, the headrest mounting arm, and the limit arm.

6. The electric adjustment device for sofa headrest according to claim 1, wherein the second fixing member has an L-shaped structure and comprises a second pivoting arm pivotally connected to the first fixing member and a backrest fixing arm extending downwardly relatively to the second pivoting arm, and the fixed end is located on the backrest fixing arm.

7. The electric adjustment device for sofa headrest according to claim 6, wherein a connecting portion in a flat structure is formed at one end of the second pivoting arm and pivotally connected to the connecting portion, and the connecting member is also fixed to the connecting portion.

8. The electric adjustment device for sofa headrest according to claim 1, wherein two limit surfaces are arranged at one end of the first fixing member pivotally connected to the second fixing member, and the second fixing member is provided with a positioning stud between the two limit surfaces, and the positioning stud cooperates with the two limit surfaces to limit a swing range of the first fixing member and the second fixing member.

9. A sofa support device, comprising a headrest support frame, a backrest support frame, and the electric adjustment device according to claim 1, wherein the first fixing member is fixed to the headrest support frame, and the fixed end of the second fixing member is fixed on the backrest support frame.

10. The sofa support device according to claim 9, further comprising an auxiliary hinge, wherein the electric adjustment device is disposed at one end of the headrest support frame and the backrest support frame, the auxiliary hinge is disposed at the other end of the headrest support frame and the backrest support frame, and the auxiliary hinge comprises a first hinge fixed to the headrest support frame and a second hinge pivotally connected to the first hinge and fixed to the backrest support frame.

* * * * *